US007161302B2

(12) United States Patent
Myojo et al.

(10) Patent No.: US 7,161,302 B2
(45) **Date of Patent: *Jan. 9, 2007**

(54) HIGH LAMP-POWER LIGHTING SYSTEM AND FLUORESCENT LAMP

(75) Inventors: Minoru Myojo, Takatsuki (JP); Akio Kitada, Hirakata (JP); Tadashi Shimizu, Hamura (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 163 days.

This patent is subject to a terminal disclaimer.

(21) Appl. No.: 10/831,910

(22) Filed: Apr. 26, 2004

(65) Prior Publication Data

US 2004/0245931 A1 Dec. 9, 2004

Related U.S. Application Data

(62) Division of application No. 10/396,630, filed on Mar. 25, 2003, now Pat. No. 6,750,613.

(30) Foreign Application Priority Data

Mar. 29, 2002 (JP) ..... 2002-096611

(51) Int. Cl.
*H01J 17/16* (2006.01)

(52) U.S. Cl. ..... 313/634; 313/643; 315/56; 315/58

(58) Field of Classification Search ..... 315/224, 315/291, 307, 56, 58; 313/634, 635, 636, 313/637, 643
See application file for complete search history.

(56) References Cited

U.S. PATENT DOCUMENTS

| | | | | |
|---|---|---|---|---|
| 4,983,888 | A * | 1/1991 | Akutsu et al. | 315/242 |
| 5,311,104 | A * | 5/1994 | Antle | 315/307 |
| 6,225,742 | B1 | 5/2001 | Iida et al. | 315/56 |
| 6,750,613 | B1 * | 6/2004 | Myojo et al. | 313/634 |
| 2002/0109462 | A1 | 8/2002 | Nishio et al. | 315/56 |

OTHER PUBLICATIONS

Proceedings of 2001 (34th) Annual Conference of The Illuminating Engineering Institute of Japan with partial translation.

* cited by examiner

*Primary Examiner*—Tuyet Vo
*Assistant Examiner*—Jimmy Vu

(57) ABSTRACT

A lighting system includes a fluorescent lamp 4 and a main body 1 for attaching the fluorescent lamp 4 thereto. The main body 1 is provided with a socket assembly 6 for the attachment of the fluorescent lamp 4, and an electronic ballast 7 for operating the fluorescent lamp 4 at dimmed levels (as well as at the full light level). The fluorescent lamp 4 is composed of a discharge tube formed of four U-shaped glass tubes that are connected together to form a square in plan view. Each glass tube has an inner diameter of 13.5 mm, and the discharge tube is filled with a rare gas containing neon and argon (at 50:50 ratio by volume).

6 Claims, 11 Drawing Sheets

FIG.7

| GAS COMPOSITION (VOL%) | | LAMP CURRENT (A) | LEAD-WIRE CURRENT (A) | DEGREE OF TUBE-END BLACKENING | SINGS OF SHORTENING LAMP LIFE |
|---|---|---|---|---|---|
| NEON | ARGON | | | | |
| 0 | 100 | 0.04 | 0.26 | NONE | NONE |
| 25 | 75 | 0.04 | 0.26 | NONE | NONE |
| 50 | 50 | 0.04 | 0.27 | NONE | NONE |
| 75 | 25 | 0.04 | 0.30 | MEDIUM | OBSERVED |

FIG.8

| | GAS COMPOSITION (VOL%) | | LAMP CURRENT (A) | LEAD-WIRE CURRENT (A) | DEGREE OF TUBE-END BLACKENING | SINGS OF SHORTENING LAMP LIFE |
|---|---|---|---|---|---|---|
| | NEON | ARGON | | | | |
| ADDITIONAL TEST 1 | 75 | 25 | 0.04 | 0.37 | SMALL TO MEDIUM | NONE |
| ADDITIONAL TEST 2 | 75 | 25 | 0.20 | 0.37 | NONE | NONE |
| COMPARATIVE TEST | 90 | 10 | 0.04 | 0.30 | LARGE | BREAK IN WIRE |

FIG.9

| | GAS COMPOSITION (VOL%) | | LAMP CURRENT (A) | CAP TEMPERATURE (℃) |
|---|---|---|---|---|
| | NEON | ARGON | | |
| PRESENT INVENTION | 0 | 100 | 0.43 | 101 |
| | 25 | 75 | 0.43 | 103 |
| | 50 | 50 | 0.43 | 111 |
| | 75 | 25 | 0.43 | 118 |
| PRIOR ART | 90 | 10 | 0.32 | 139 |

HIGH LAMP-POWER LIGHTING SYSTEM AND FLUORESCENT LAMP

This application is a divisional based of U.S. application Ser. No. 10/396,630 filed Mar. 25, 2003 which is now U.S. Pat. No. 6,750,613.

BACKGROUND OF THE INVENTION

1. Field of the Invention

The present invention relates to a lighting system for operating a fluorescent lamp with dimming control, and also to a fluorescent lamp.

2. Description of the Related Art

Compact single-capped fluorescent lamps (hereinafter simply referred to as "fluorescent lamps") are becoming prevalent for their high lamp efficiency as a light source of a lamp apparatus provided at commercial facilities and offices in a buried condition in a ceiling (hereinafter, such a lamp apparatus is referred to as a "downlight").

There are various types of fluorescent lamps with different lamp powers for various locations and purposes of use. The fluorescent lamps are uniform in the outside diameter of a glass tube constituting a discharge tube and in a nominal lamp current. Each fluorescent lamp, however, differs from others in the lamp power due to a different length of the discharge tube and a different ratio by volume of neon and argon contents sealed within the discharge tube.

For example, when a fluorescent lamp is composed of a discharge tube having an inside diameter of 10.5 mm and a nominal lamp current of 0.32 A, the lamp power may be made to differ within the range of 16–57 W by varying the length of discharge tube within the range of 68–165 mm and the neon content by volume within the range 30–90%.

Further, when used with an electronic ballast, a fluorescent lamp may be "dimmed" so as to produce a smaller light output over a full range in response to reduction in the lamp current applied thereto. Such a dimmable lighting system is now in wider use.

Generally, electrode filaments of a fluorescent lamp are designed to reach an optimal temperature for thermoelectronic emission upon application of the maximum lamp current (approximately equal to the nominal value). In other words, when the lamp current is reduced for dimming, the temperature of electrode filaments is reduced. To compensate for the temperature reduction, a filament current is supplied to the electrode filaments additionally to the lamp current, so that the temperature of electrode filaments is maintained within an appropriate range.

Unfortunately, when operated at a dimmed level, above fluorescent lamps with high lamp-power (hereinafter, referred to as high-output fluorescent lamps) have following problems although such problems do not occur in fluorescent lamps with low lamp-power. That is, when operated at a dimmed level, ends of the discharge tube are blackened, and the electrode filaments are exhausted, which shortens life of the lamp.

These problems are caused in the following mechanism. In the case of a high-output fluorescent lamp, the neon content is high and thus the cathode voltage drop is large. In synergy with this, the temperature of electrode filaments rises excessively. Because of the excessively high temperature, the thermoelectronic emission material (hereinafter referred to as emitter) coated over the electrode filaments evaporates, and charged particles present around the electrodes are accelerated to cause sputtering of the electrode filaments to a greater extent. As a result, the electrode filaments are more quickly exhausted. In addition, when the lamp current is reduced for dimming, it equally means that the electronic current is reduced as well. As a result, electrons emitted from the surface of the electrode filaments are reduced, so that less cooling effect is achieved.

SUMMARY OF THE INVENTION

In view of the above problems, a first object of the present invention is to provide, without upsizing a discharge tube, a lighting system with high lamp-power that is free from blackening of the discharge tube ends or loss of the lamp life even when operated at a dimmed level. A second object of the present invention is to provide a fluorescent lamp that is free from blackening of discharge tube ends or loss of the lamp life when used in a lighting system for dimming.

The first object stated above is achieved by a lighting system including a fluorescent lamp and an electronic ballast. The fluorescent lamp is composed of a discharge tube that is formed of at least one glass tube which is bent, and filled with a rare gas containing at least argon. The electronic ballast is for operating the fluorescent lamp with dimming control. An inside diameter of the glass tube is within a range of 12–15 mm. An overall size of the discharge tube is such that a maximum diameter is within a range of 55–70 mm and a maximum length is within a range of 120–220 mm. The electronic ballast applies a nominal lamp current to operate the fluorescent lamp at a full light level. With this construction, the lamp power is increased without involving increase in the ratio of neon content by volume. Therefore, the fluorescent lamp is free from blackening of the discharge tube ends and loss of the lamp life even when operated at a dimmed level. Further, an overall size of the discharge tube is such that a maximum diameter is within a range of 55–70 mm and a maximum length is within a range of 120–220 mm, and thus the discharge tube is applicable to a lighting system employing a downlight. Note that the term "operation at a full light level" means that the lamp is operated by applying the nominal lamp current.

Further, the rare gas may additionally contain up to 75 vol % of neon. With this construction, blackening of the discharge tube ends and loss of the lamp life are suppressed even when the fluorescent lamp is operated at a dimmed level.

Further, each glass tube may be bent to form a substantially U-shape. The discharge tube may be formed of a plurality of the U-shaped glass tubes connected together, and the glass tubes may be arranged to form a polygonal shape in plan view. With this construction, there is no inconsistency in light radiation in the circumferential direction of the discharge tube, so that light is distributed substantially uniformly in the circumferential direction. Here, the term "plan view" refers to the state that the discharge tube is seen from the direction in which the straight portions of the U-shape extend.

Further, the discharge tube may be formed of four U-shaped glass tubes. With this construction, a longer discharge path is formed to improve the lamp output with a size substantially same as a discharge tube formed by, for example, three U-shaped glass tubes.

The second object of the present invention stated above is achieved by a fluorescent lamp that is composed of a discharge tube. The discharge tube is formed of at least one glass tube which is bent, and filled with a rare gas containing at least argon. An inside diameter of the glass tube is within a range of 12–15 mm. An overall size of the discharge tube is such that a maximum diameter is within a range of 55–70 mm and a maximum length is within a range of 120–220 mm.

With this construction, the lamp power is increased without increasing the ratio of neon content by volume. In addition, the fluorescent lamp is free from loss of the lamp life even when operated at a dimmed level.

Further, the rare gas may additionally contain up to 75 vol % of neon. With this construction, the fluorescent lamp is free from blackening of the discharge tube ends and loss of the lamp life even when operated at a dimmed level.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 7 is a view showing influence exerted by a different content of neon on fluorescent lamp performance;

FIG. 8 is a view showing influence exerted by a different lamp current on performance of fluorescent lamp having the neon content of 75% by volume;

FIG. 9 is a view showing the relation between a ratio of neon content by volume and a cap temperature;

DESCRIPTION OF THE PREFERRED EMBODIMENT

Hereinafter, with reference to the accompanying drawings, description is given to an embodiment where a lighting system of the present invention is applied to a downlight.

I. Downlight Construction

Figure 1:
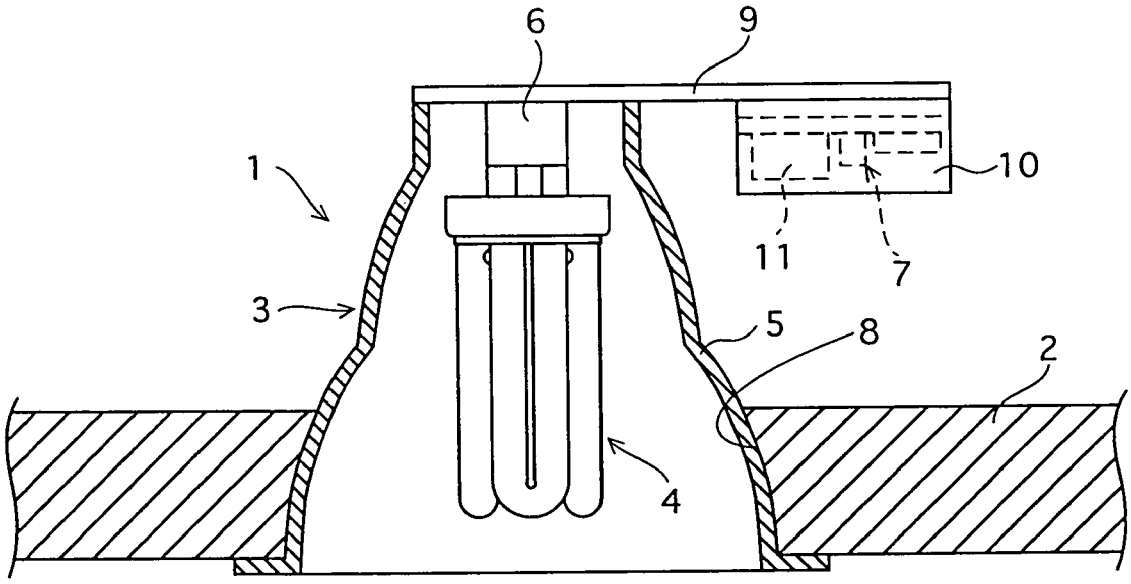
FIG. 1 is a partly-broken front view showing a lighting system of the present invention that is provided in a berried condition in a ceiling.

FIG. 1 is a view showing the overall construction of a downlight of the present invention with a part of the figure being broken away to show the internal structure. As shown in the figure, the downlight 1 is composed of a main body 3 buried in a ceiling 2, and a compact single-capped fluorescent lamp 4 (hereinafter, simply referred to as the "fluorescent lamp 4") attached to the main body 3.

1) Main Body

The main body 3 is provided with a shade assembly 5 that expands downwardly, a socket assembly 6 provided inside the shade assembly 5 for detachably attaching the fluorescent lamp 4 thereto, and an electronic ballast 7 for operating the fluorescent lamp 4 being attached to the socket assembly 6 at the full light level and dimmed levels. There is a mounting aperture 8 formed in the ceiling 2, and the outer circumference of the shade assembly 5 engages against the mounting aperture 8 so that the main body 3 is installed.

The inner surface of the shade assembly 5 is mirror-finished or coated with white paint, so that light emitted from the fluorescent lamp 4 is effectively radiated downwardly. Mounted at the top of the shade assembly 5 is a base plate 9 extending in the direction parallel to the ceiling 2 (the lateral direction in FIG. 1). The socket assembly 6 and the electronic ballast 7 are mounted to the base plate 9 at such positions that the socket assembly 6 comes inside the shade assembly 5 and the electronic ballast 7 comes outside.

The socket assembly 6 is provided with four connecting holes (not illustrated). When connecting pins 15 (see FIG. 3) of the fluorescent lamp 4 are inserted into the connecting holes, an electrical connection is provided between the fluorescent lamp 4 and the socket assembly 6.

The electronic ballast 7 is housed in a case 10 that is mounted to the base plate 9. The electronic ballast 7 operates the fluorescent lamp 4 at the full light level. In addition, the electronic ballast 7 controls the lamp current and applies a filament current when operating the fluorescent lamp 4 at a dimmed level.

Figure 2:
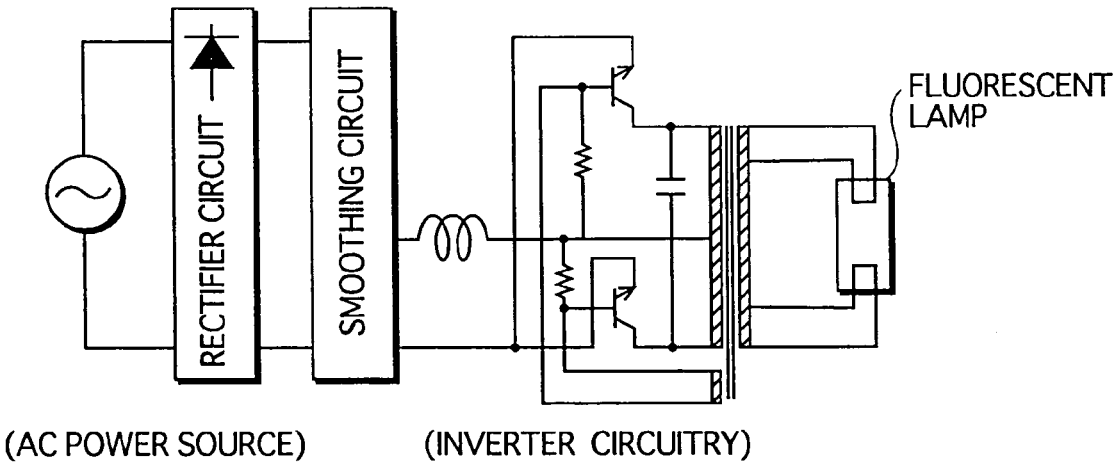
FIG. 2 is a block diagram showing circuitry of an electronic ballast of the present invention.

FIG. 2 is a block diagram showing circuitry of the electronic ballast 7. As shown in the figure, the electronic ballast 7 includes a rectifier circuit, a smoothing circuit, and an inverter circuit. Receiving alternating voltage supplied from an AC power supply, the electronic ballast 7 converts the alternating voltage to direct voltage that are rectified and smoothed through the rectifier circuit and the smoothing circuit, and the thus converted direct voltage is made to high-frequency voltage through the inverter circuit. Note that the inverter circuit employed in the present embodiment is of a so-called constant current push-pull type. The electronic ballast 7 thus supplies the lamp current and the filament current at high frequencies on the order of several tens of kHz.

2) Florescent Lamp Construction

Figure 3:
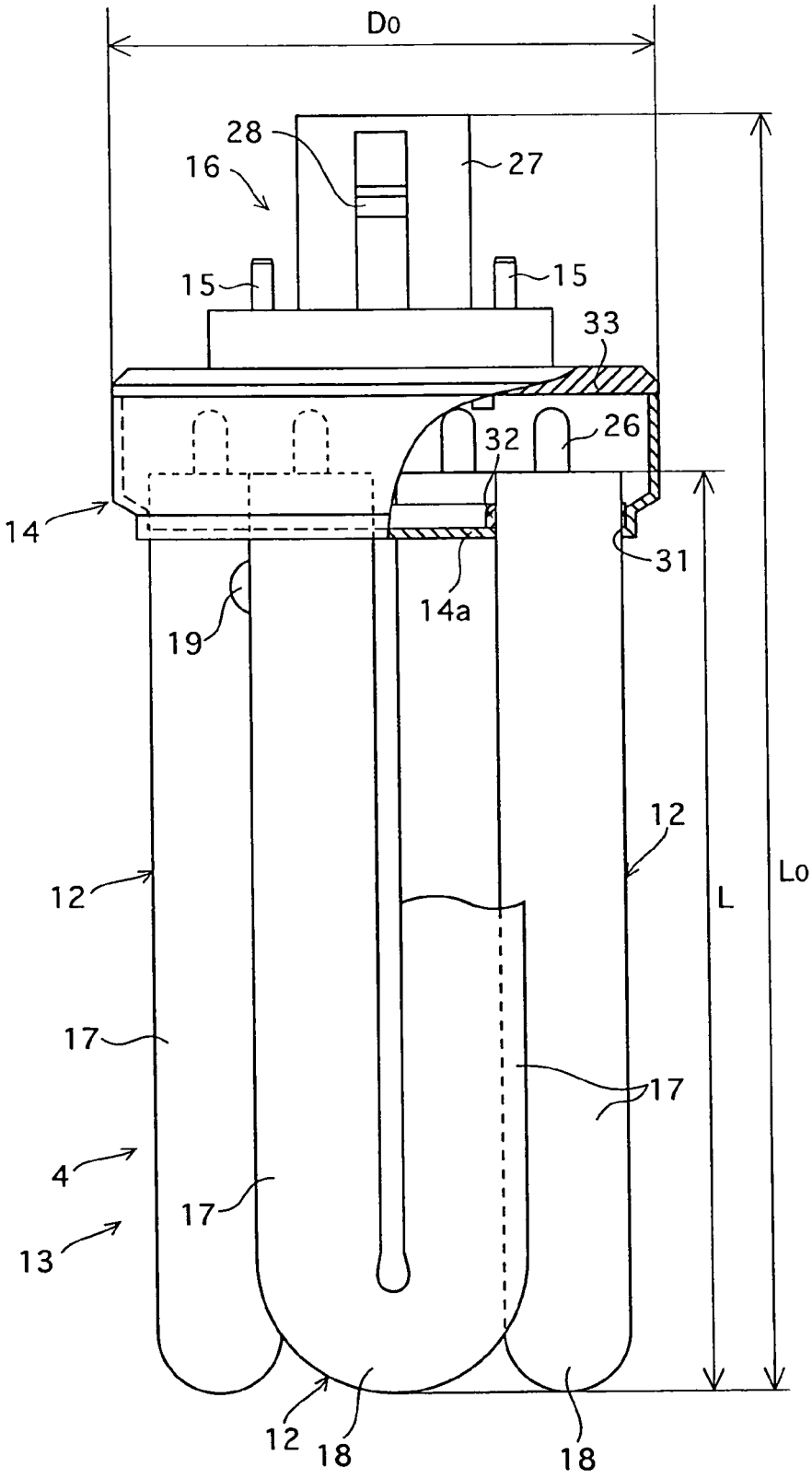
FIG. 3 is a front view showing a fluorescent lamp of the present invention.
Figure 4:
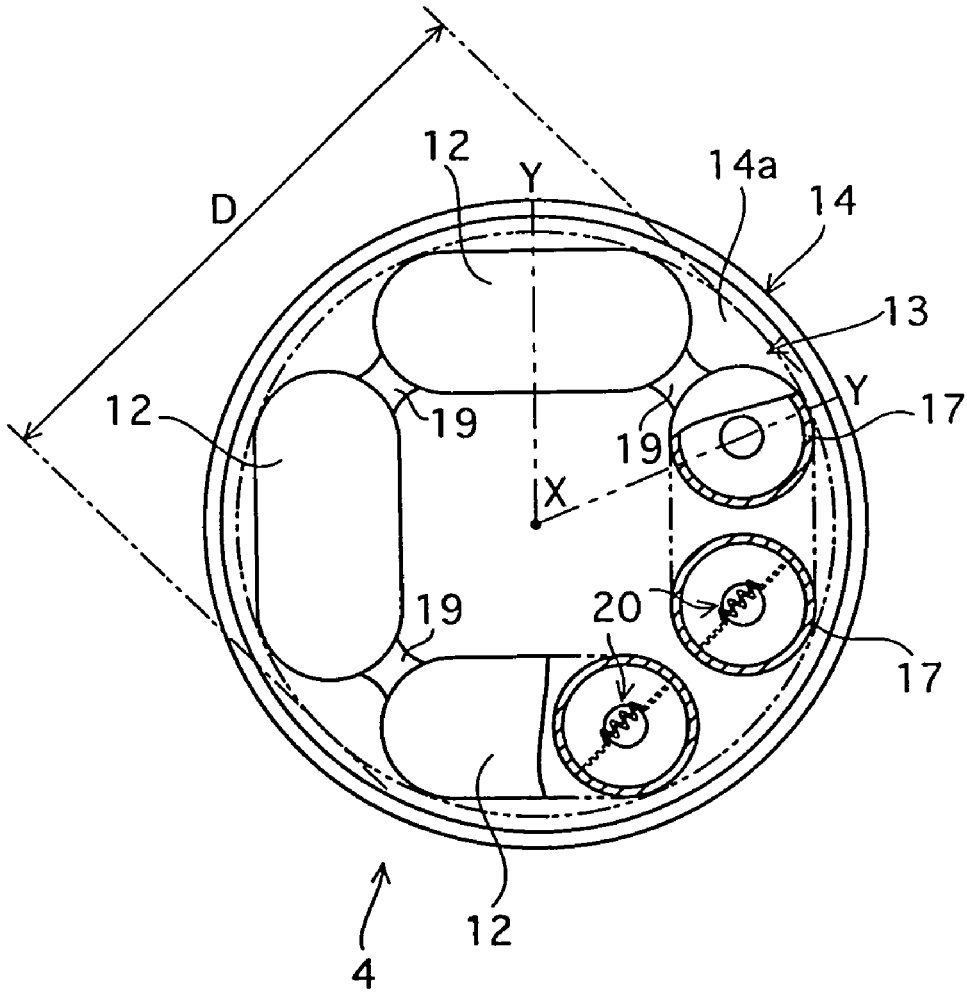
FIG. 4 is a bottom view showing the fluorescent lamp of the present invention.

FIG. 3 is a partly-broken front view showing the internal structure of the fluorescent lamp 4, and FIG. 4 is a bottom view of the fluorescent lamp 4. The line in FIG. 3 along which the fluorescent lamp 4 is broken away corresponds to the YXY line in FIG. 4. Note that the glass tubes in FIG. 3 are shown without being broken away for the sake of convenience.

As shown in FIGS. 3 and 4, the fluorescent lamp 4 is composed of a discharge tube 13 that is formed of a plurality of bent glass tubes 12 connected together, and a base assembly 14 for holding the discharge tube 13, and a cap 16 for attachment of the main body 3 to the socket assembly 6.

The discharge tube 13 is formed of four U-shaped glass tubes 12 that are connected together (also see FIG. 1) to form one discharge path meandering up and down. Each glass tube 12 has an inner surface coated with rare-earth phosphor (not illustrated). Similarly to phosphor typically used in a conventional fluorescent lamp, the phosphor used in this embodiment is tri-band phosphor (red, green and blue emission) having a color temperature of 5000 K. To be more specific, the phosphor is a mixture of europium-activated yttrium oxide phosphor (red), cerium- or terbium-activated lanthanum phosphate phosphor (green), and a europium-activated barium aluminate magnesium phosphor (blue).

Each glass tube 12 has a pair of straight portions 17 and a bend portion 18. The pair of straight portions 17 is substantially straight tubes that extend vertically in substantially parallel relation to each other. The bend portion 18 is a curved tube connecting the two straight portions 17 at the bottom. As shown in FIG. 4, the four glass tubes 12 are arranged, in plan view, in a substantially square array of which center substantially coincides with the center of the base assembly 14, i.e., the lamp axis X. In addition, each two adjacent straight portions 17 of a different glass tube 12, except one pair, are bridge-connected to each other at the bottom in a manner to allow communication therebetween. Each straight portion 17 of the unconnected pair is provided with an electrode 20 therein.

Figure 5:
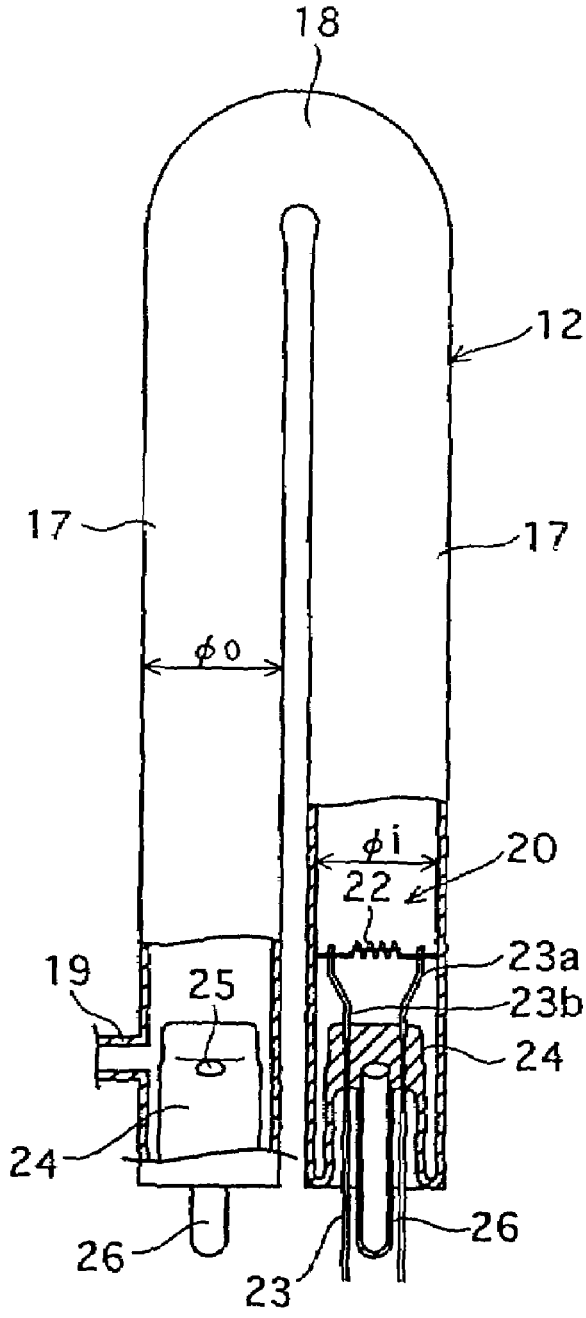
FIG. 5 is a partly-broken front view showing a glass tube that is provided with an electrode.

FIG. 5 is a front, partly-broken view showing the bottom of the glass tube 12 that is provided with the electrode 20. As shown in the figure, the electrode 20 is composed of an electrode filament 22 made of a tungsten wire, and lead wires 23*a* and 23*b* each of which is connected to a different end of the electrode filament 22. The lead wires 23*a* and 23*b* are fixed in place at the bottom by sealing the glass tube 12 with a stem 24. That is to say, the electrode filament 22 is supported by the pair of lead wires 23*a* and 23*b*.

Note that the lead-wire current is a larger one of the two currents flowing through the lead wires 23*a* and 23*b*. Each current is a resultant total of the lamp current and the filament current.

Additionally to the stem 24 mentioned above, a stem 24 is also provided at the end of each straight portion 17 (at the left in the figure) where no electrode 20 is provided. Consequently, the stems 24 hermetically seal the discharge tube 13. Formed through each stem 24 is a vent hole 25 that is in communication with a fine tube 26. The fine tube 26 is made of glass and provided in a manner to extend out downwardly from the bottom surface of the stem 24. The fine tube 26 is used to evacuate air from the discharge tube 13 and to fill a later-described rare gas into the discharge tube 13. The rare gas employed herein contains argon and neon.

Referring back to FIG. 3, the base assembly 14 has a cylindrical shape provided with a bottom at one end. The bottom constitutes a holder part 14*a* that actually holds the discharge tube 13. An open end of the base assembly 14 is closed with a closure assembly 33 to which the cap 16 is mounted. As shown in FIG. 4, the holder part 14*a* is substantially circular in plan view. Each glass tube 12 together constituting the discharge tube 13 is attached to the holder part 14*a* at one end thereof, so that the center of the holder part 14*a* substantially coincides with the center of the substantially square array along which the glass tubes 12 are arranged.

As shown in FIG. 3, the holder part 14*a* is provided with eight insertion apertures 31 correspondingly to the glass tubes 12 of the discharge tube 13. The straight portions 17 of the glass tube 12 are inserted into the insertion apertures 31 and fixed with an adhesive 32, for example. Note that in the case where the adhesive 32 is employed, it is preferred that the adhesive 32 have excellent heat-resistance as the temperature of the discharge tube 13 rises high during operation of the fluorescent lamp 4 at the full light level or dimmed levels.

The cap 16 is provided with a fixture part 27 to be inserted into a fixture hole of the socket assembly 6, and the four, vertically extending connecting pins 15. The fixture part 27 is provided with an engaging pawl 28 for engagement with a recess formed as a part of the fixture hole. When the fixture part 27 is inserted into the fixture hole of the socket assembly 6, the engaging pawl 28 engages with the recess, so that the fluorescent lamp 4 is detachably attached to the socket assembly 6. Being attached to the socket assembly 6, the connecting pins 15 come to be inserted into the connecting holes of the socket assembly 6, whereby the socket assembly 6 is electrically connected to the fluorescent lamp 4.

The base assembly 14 is made from a synthetic resin. Preferably, the synthetic resin has an excellent heat-resistance as the temperature around the electrodes 20 rises high at the time of full light operation of the fluorescent lamp. Examples of such a synthetic resin include PET (polyethylene terephthalate).

3) Concrete Construction and Dimmed Operation Property a) Concrete Construction

As shown in FIG. 5, each glass tube 12 together constituting the discharge tube 13 has an inside diameter (hereinafter referred to as the "tube I.D. φi") of 13.5 mm, and an outside diameter (hereinafter referred to as the "tube O.D. φo") of 15.5 mm, and is bent to form a substantial U-shape.

The discharge tube 13 is formed of the four U-shaped glass tubes 12 that are bridge-connected. As shown in FIG. 3, the overall size of the discharge tube 13 is such that the maximum outside diameter D is 61 mm and the maximum length L in the vertical direction (the direction of the lamp axis X) is 190 mm. Here, the maximum outside diameter refers to the one measured where it is greatest. The maximum length L refers to a longest one among lengths of each discharge tube 12 in the vertical direction, i.e., a distance between the sealing end and the outermost point of the bend. (The vertical direction is a direction in which the glass tubes 12 extend from the base assembly 14, and also referred to as the lamp axis X direction.)

The discharge tube 13 is filled with a rare gas at a pressure of 500 Pa along with mercury vapor. The rare gas contains argon and neon at the ratio of 50:50 percent by volume. Upon application of the nominal lamp current of 0.43 A under control by the electronic ballast 7, the fluorescent lamp 4 produces the lamp power of 75 W. The outside diameter Do of the fluorescent lamp 4 is 76 mm and the length Lo is 220 mm (see FIG. 3).

b) Dimmed Operation Property

The fluorescent lamp 4 was operated at a dimmed level with the use of electronic ballast 7 for 75 W. During the operation, the fluorescent lamp 4 was held with the cap 16 at the top (hereinafter, referred to as "cap-up operation"). The result is shown in FIG. 6.

Figure 6:
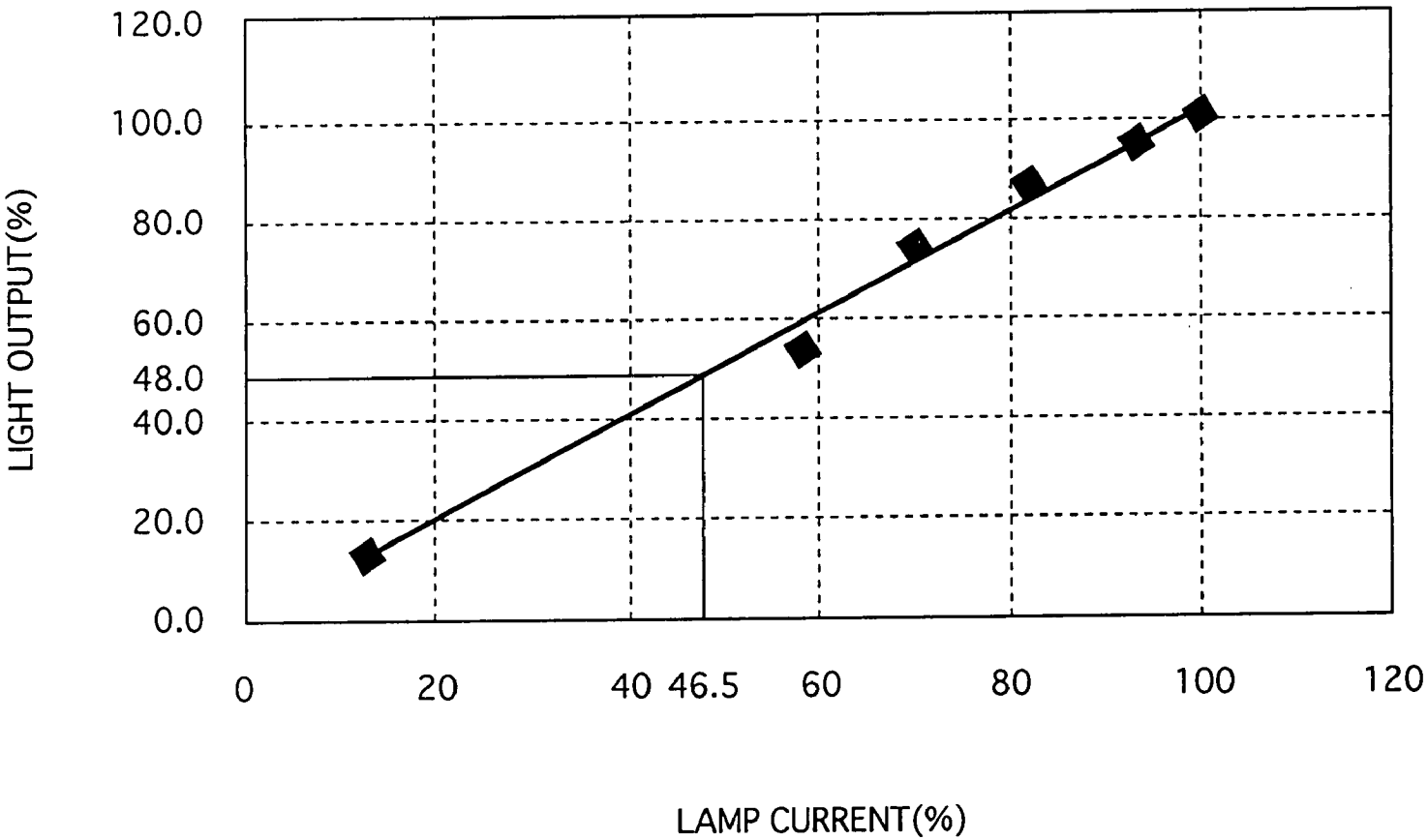
FIG. 6 is a view showing the relation between two ratios, one is of a lamp current under dimming control to a nominal lamp current and the other is of a light output to a full light output.

FIG. 6 is a view showing the relation between two ratios, one is a ratio of the measured lamp current to the nominal lamp current, and the other is a ratio of the measured light output to the light output upon the nominal lamp current application. In the figure, the former ratio is labeled simply as "lamp current", and the latter ratio is labeled simply as "light output".

As shown in the figure, when the lamp current was varied from 12.5% (0.054 A) to 100% (0.43 A) of the nominal lamp current, the resulting light output correspondingly varied from 14% to 100% of the full light level. Especially noted is that when the lamp current was reduced to 0.054 A, the light output was reduced to 14% of the full light output that would be produced upon application of the nominal lamp current. The results confirm that the florescent lamp 4 was deep-dimmable.

II. Relevant Studies

Inventors of the present invention have conducted various studies to develop the fluorescent lamp 4 that is of a high-output type and yet dimmable. The studies were conducted on the fluorescent lamps 4 fixable to the downlight 1 and thus composed of the discharge tube 13 of up to 70 mm in the maximum outside diameter D, and up to 220 mm in the maximum length L.

1) Inside Diameter of Glass Tube

Through various studies, the inventors of the present invention have found that the preferable tube I.O. ϕi of the glass tube 12 falls within the range of 12–15 mm.

This is because when the tube I.O. ϕi of the glass tube 12 was smaller than 12 mm, the starting voltage was excessively high due to the small tube I. O. ϕi. Such a high starting voltage made it difficult to design an electronic ballast 7 that would be suitably used for the fluorescent lamp 4. In addition, since the tube I.O. ϕi was small, each electrode 20 was relatively closer to the inner surface of a corresponding one of the glass tubes 12. Thus, the sputter from each electrode 20 blackened the ends of the discharge tube 13 significantly, thereby decreasing the luminous flux maintenance factor. Further, upon application of a larger lamp current to increase the light output, the lamp current density through the glass tubes 12 increased more significantly due to the small tube I.O. ϕi, which resulted in reduction in the lamp efficiency.

On the other hand, when the tube I.O. ϕi of the glass tube 12 was larger than 15 mm, it was inevitable to upsize the fluorescent lamp 4 to ensure a discharge path having a length that would be sufficient to obtain luminous flux with desired intensity. In other words, the object of the present invention to realize a small-sized fluorescent lamp ended up in failure.

In addition, when the tube I.O. ϕi of the glass tube 12 was larger, it was more difficult to uniformly heat a portion of the glass tube 12 to form the bend portion 18. As a consequence, yields reduced in a manufacturing step of molding the glass tube into a U-shape.

Contrary to the above, when the tube I.O. ϕi of the glass tube 12 was within the range of 12–15 mm, there was almost no blackening of the ends of the discharge tube 13 caused by sputter from the electrodes 20. In addition, molding of the glass tube 12 to a U-shape was carried out without the above-stated problem. In other words, it was confirmed that when the tube I. O. ϕi of the glass tube 12 was within the range specified above, there was no problem in both practicality and manufacturability.

2) Nominal Lamp Current

Through various studies, the inventors of the present invention have also found that the preferable nominal lamp current falls within the range of 0.40–0.50 A.

This is because when the nominal lamp current was smaller than 0.40 A, the lamp power was smaller so that a desired level of light output (full light output) was hardly obtained.

When the nominal lamp current was larger than 0.50 A, on the other hand, the lamp current increased and thus the resulting light output was higher. Yet, since the lamp current density increased as well, the lamp efficiency decreased. In view of the above results, it was confirmed that the nominal lamp current preferably fell within the range of 0.40–0.50 A.

3) Composition Ratio of Rare Gas

Next, another study was conducted using a plurality of the fluorescent lamps 4 specifically described in the embodiment to check influence exerted by a different content of neon on the performance of each fluorescent lamp 4. To be more specific, four different fluorescent lamps 4 were prepared with 0%, 25%, 50%, and 75% of neon content by volume. Each fluorescent lamp 4 was operated at a dimmed level with the electronic ballast 7 by applying a lamp current of 0.04 A, which corresponded to about 9% of the nominal lamp current of 0.43 A. After 1000 hours of operation, each fluorescent lamp 4 was observed to check blackening of ends of the glass tube 12 and signs of loss of the lamp life.

The results are shown in FIG. 7. Note that the fluorescent lamp 4 with the neon content of 50% by volume had the lamp power of 75 W, which was higher than a conventional lamp power of 57 W.

In the figure, "degree of tube-end blackening" shows the results of visual inspection made to check how much blackening was caused at the ends of the discharge tube 13 by deposition of the emitter evaporated from the electrode filaments 22. Also, "signs of shortening lamp life" shows the judgment results made based on the ratio of (1) the amount of emitter lost from the electrode filaments 22 during 1000 hours of dimmed operation to (2) the amount of emitter lost from the electrode filaments 22 during 1000 hours of full light operation (i.e., without dimming control). In the figure, "none" represents that the ratio was not less than 70%, while "observed" represents the ratio was less than 70%.

As apparent from FIG. 7, when the ratio of neon content was 0–50% by volume, the fluorescent lamp 4 described in the present embodiment exhibited no tube-end blackening after 1000 hours of dimmed operation. In addition, there was observed no sings of shortening the lamp life.

This is probably due to the following reason. When the ratio of neon content in the rare gas was not more than 50% by volume, the resulting cathode voltage drop of the fluorescent lamp was not excessively large. Thus, although the smaller lamp current under dimmed operation caused to reduce the electrode cooling effect of thermoelectronic emission, the temperature rise in the electrode filaments 22 was still prevented. However, when the ratio of neon content was 75% by volume, the fluorescent lamp started to show sings of tube-end blackening as well as signs of shortening the lamp life.

In the above study, when the neon content was 75% by volume, the fluorescent lamp exhibited sings of tube-end blackening and sings of shortening the lamp life, which were not observed in the fluorescent lamps with the neon content of 0–50% by volume. In view of the above results, another study was conducted on the fluorescent lamp 4 with the neon content of 75% by volume to see whether the fluorescent lamp would be dimmable.

The study was conducted on the fluorescent lamps all with the neon content of 75% by volume but with different lamp current and lead-wire current. To be more specific, two tests were conducted under the following conditions. In one test, the lamp current was 0.04 A similarly to the above test, but the lead-wire current was 0.37 A rather than 0.30 A (hereinafter, this test was referred to as "additional test 1"). In another test, the lead current was 0.37 A similarly to the additional test 1, but the lamp current was 0.20 A rather than 0.04 A (hereinafter, "additional test 2"). The results are shown in FIG. 8. FIG. 8 also shows the result of another test (hereinafter, "comparative test") conducted on a fluorescent lamp having the neon content of 90% by volume for the purpose of comparison with the fluorescent lamp having the neon content of 75% by volume.

In the additional test 1, the emitter evaporated to cause blackening of the tube ends but to small to medium degree, which was less than the one observed in the fluorescent lamp with the lead-wire current of 0.30 A. In addition, although sings of shortening the lamp life were observed to a certain extent in the fluorescent lamp with the lead-wire current of 0.30 A, there were no such sings observed in the fluorescent lamp with the lead-wire current of 0.37 A. This may be because when the neon content was 75% or so by volume, application of the filament current acted to lower the temperature of the electrode filaments 22.

On the other hand, in the additional test 2, neither tube-end blackening nor sings of shortening the lamp life was observed unlike the fluorescent lamp with the lamp current of 0.04 A (see FIG. 7). It is believed that the higher lamp current of 0.2 A served to emit more electrons, thereby achieving the electrode cooling effect.

The results of the additional tests confirmed that the fluorescent lamp with the neon content of 75% by volume was dimmable without causing blackening of the tube ends and shortening the lamp life, and thus practicable as long as the lamp current and the lead wire current were set to be optimum.

As shown in FIG. 6, when the lamp current was set at 0.20 A (46.5%), light output was 48% of the full light output, and thus deep dimming was not achieved. Yet, such a fluorescent lamp is sufficiently applicable to the case where the fluorescent lamp needs to be dimmed only to 50% over the full light output during, for example, midnight in order to reduce power consumption. As such, the fluorescent lamp achieves some effects.

Further, in the comparative test made on the fluorescent lamp with the neon content of 90% by volume, there was no optimum value either for the lamp current or for the lead-wire current. Regardless of the lamp current or the lead-wire current applied thereto, the fluorescent lamp exhibited blackening from an initial stage of the test, and signs of shortening the lamp life were observed from an early stage of the operation. The electrode filament broke before 1000 hours of operation. This is ascribable to the large cathode voltage drop, as described in the above section of "background of the invention".

In view of the above tests and studies, it has been confirmed that the fluorescent lamp 4 is dimmable as long as the neon content in the rare gas is within the range of 0–75% by volume.

4) Pressure of Rare Gas

In the fluorescent lamp 4 described in the present embodiment, a rare gas is sealed within the discharge tube 13 at a pressure of 500 Pa. It is preferable that the sealing pressure of rare gas fall within the range of 300–600 Pa.

When the sealing pressure is less than 300 Pa, mercury vapor generates a greater amount of ultraviolet radiation of 185 nm, which more quickly deteriorates the phosphor that coats the inner surface of the glass tube 12 as well as the glass tube 12 itself. As a result, the luminous flux maintenance factor decreases over long hours.

On the other hand, when the sealing pressure exceeds 600 Pa, the density of molecules present in the discharge space is high so that collisions of electrons occur in a greater number. As a consequence, a greater loss is caused by elastic collision of electrons, which reduces the lamp efficiency.

5) Size

The fluorescent lamp 4 described in the present embodiment is for use in downlight. Accordingly, it is preferable that the overall size of the discharge tube 13 is such that the maximum outside diameter D is 70 mm or smaller and the maximum length L is 220 mm or shorter. A discharge tube larger than the above specified size is not readily applied to a downlight lighting system.

Further, the discharge tube 13 preferably has the outside diameter D greater than 55 mm. This is the size of a discharge tube when formed by using three or more U-shaped glass tubes 12 each having a permissible minimum inside diameter of 12 mm. When the maximum outer diameter D is 55 mm or less, it means that three or more U-shaped glass tubes 12 are not possibly connected, so that a desired level of light output (full light output) is not possibly produced.

Further, it is more preferable that the discharge tube 13 be 58 mm or greater in the maximum outside diameter D. By making the discharge tube 13 substantially equal in size to the limit to be applicable to a conventional downlight lighting system, the inside diameter of the glass tube 12 is made practical largest. With this arrangement, the current density in the discharge tube is made small and thus the lamp efficiency improves. In addition, the tube-wall loading is made small, and thus the luminous flux maintenance factor improves.

Further, it is preferable that the entire length along the discharge tube 13 be longer than 120 mm in order to achieve light output at a desired level (full light output).

6) Cap Temperature

Conventionally, a fluorescent lamp with a high ratio of the neon content has a problem in that the cap temperature rises excessively high under a stationary operation at the full light level. However, the fluorescent lamp 4 of the present invention manages to lower temperature of the cap 16 under a stationary operation at the full light level.

First, description is given to the mechanism of how the high neon content causes the cap temperature to rise excessively.

The high neon content results in a large cathode voltage drop, which in turn causes to increase heat loss around the electrodes.

Contrary, the fluorescent lamp 4 of the present invention (the neon content is 50% by volume) is not high in the neon content ratio by volume despite the relatively high lamp power of 75 W. Here, it is assumed that the temperature rise of the cap 16 is thus prevented during stationary operation of the fluorescent lamp 4 at the full light level.

To confirm the above assumption, tests were conducted to study the relation between the ratio of neon content by volume and the temperature of the cap 16 under stationary operation at the full light level. To be specific, four different fluorescent lamps 4 were prepared with the neon content of 0%, 25%, 50%, and 75% by volume. The nominal lamp current (0.43 A) was applied to each fluorescent lamp 4 to measure the temperature of the cap 16 during stationary operation of the lamp at the full light level. Note that the ambient temperature of the fluorescent lamp at the time of full light operation was controlled to be 25° C.

The results were shown in FIG. 9. FIG. 9 also shows the result of another test conducted on a conventional fluorescent lamp (the lamp power of 57 W and the neon content of 90% by volume, hereinafter, referred to as the "prior art product") for comparison. The prior art product was operated at the nominal lamp current (0.32 A) to measure the temperature of the cap.

As shown in FIG. 9, the higher the neon content by volume was, the higher the temperature of the cap 16 was. Yet, the fluorescent lamp 4 of the embodiment (the neon content of 50% by volume) resulted in the temperature of the cap 16 of up to 111° C., while the prior art product resulted in the cap temperature of 139° C. In order words, the cap temperature of the fluorescent lamp 4 was lower by 28° C. when compared to the prior art product irrespective of the fact that the fluorescent lamp 4 had the lamp power 75 W, which was 1.3 times higher than the lamp power 57 W of the prior art product. The test results show that the present invention is effective to prevent temperature rise in the cap 16.

7) Supplementary Note

In the present embodiment, the present invention is applied to a compact fluorescent lamp with the lamp power of 75 W. However, it is naturally understood that the present invention may be applied to a fluorescent lamp having a lamp power other than 75 W. In such a case, the neon content in the rare gas is determined depending on the inner diameter of the glass tubes constituting the discharge tube, the electrode distance, and the nominal lamp current. The fluorescent lamp is dimmable as long as the neon content is up to 75% by volume.

Modifications

Up to this point, the present invention has been described by way of the specific embodiment. However, it is naturally understood that the present invention is in no way limited to the specific embodiment described above. Various modifications may be made as follows.

I. Glass Tube and Discharge Tube

The bend portion of each glass tube may be circular or elliptical. Further, the glass tube in cross section may be circular or elliptical, for example. In short, the glass tube may have any shape as long as it allows for smooth migration of mercury vapor thorough the discharge path.

Still further, in the fluorescent lamp in the above embodiment, each straight portion of the glass tubes constituting the discharge tube extends perpendicularly to the base assembly, i.e., the holder part, and thus substantially parallel to the lamp axis X. However, such a construction is arbitrarily selected that the straight portions are inclined to the lamp axis X depending on desired light distribution or usage.

Still further, in the above embodiment, each U-shaped glass tube has a pair of straight portions that are substantially in parallel to each other. Yet, each glass tube may be formed to have a pair of straight portions that are inclined so as to be closer to each other at a bend side than at a base assembly side. Yet, as the inclination angle of the straight portions is greater, it is more difficult to achieve the fluorescent lamp that is compact in size. Thus, the inclination angle should not be too great.

Further, although the discharge tube in the embodiment above is formed of four U-shaped glass tubes that are connected together, the discharge tube may be formed by connecting three U-shaped glass tubes or five U-shaped glass tubes. In the latter case, it is necessary to shorten the distance between adjacent glass tubes as well as the distance between each pair of straight portions.

When the discharge tube is formed of three U-shaped glass tubes, the resulting discharge path is shorter than that formed of four U-shaped glass tubes. Thus, for example, the U-shape needs to be longer in length (corresponding to the length L in FIG. 3) to secure a sufficient length of discharge path.

On the other hand, when the discharge tube is formed of five U-shaped glass tubes, the distance between adjacent glass tubes are shorter, which makes it difficult to connect the glass tubes. Further, since the distance between each pair of straight portions needs to be shorter, it is also difficult to bend the glass tube to form such a U-shape.

Still further, unlike the embodiment above, the glass tube may be bent to form a shape other than a U-shape. For example, the glass tube may be shaped into a single helical form having a bend portion and a wound portion, or to a double helical form having a bend portion and two wound portions on both sides of the bend portion. With the double helical shape, for example, the discharge path through the discharge tube is made longer within a limited capacity.

II. Base Assembly

In the above embodiment, the base assembly is substantially circular in plan view. Alternatively, however, it may be polygonal, or regular octagonal. Further, the base assembly may be made from heat-resistant ceramics. Further, although the above description is given to the cap that is provided with the connecting pins, another type of cap, such as E26 type may be employed.

In the embodiment above, the discharge tube is filled with mercury vapor alone. It is applicable, for example, to provide therein a mercury-containing main amalgam for regulating the pressure of mercury vapor, and an auxiliary amalgam for starting aid and for accelerating start up of the lamp.

Figure 10A:
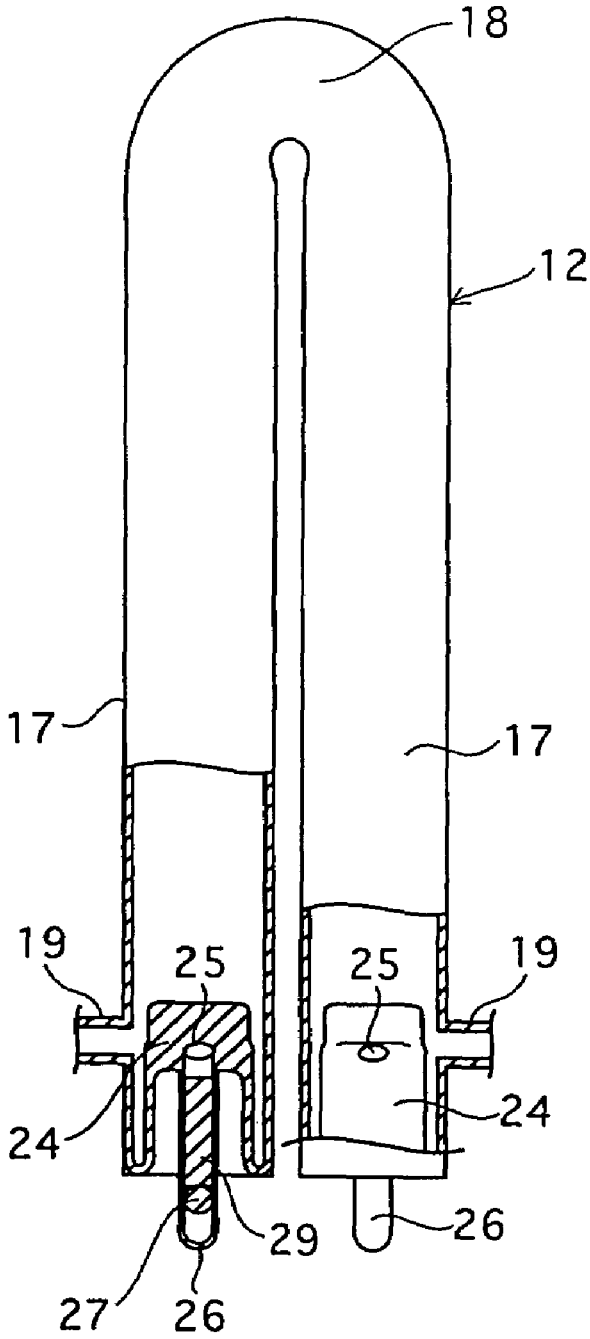
FIG. 10A is a side view showing a discharge tube that is provided with a main amalgam therein, and a part of the figure is broken away to show the main amalgam.
Figure 10B:
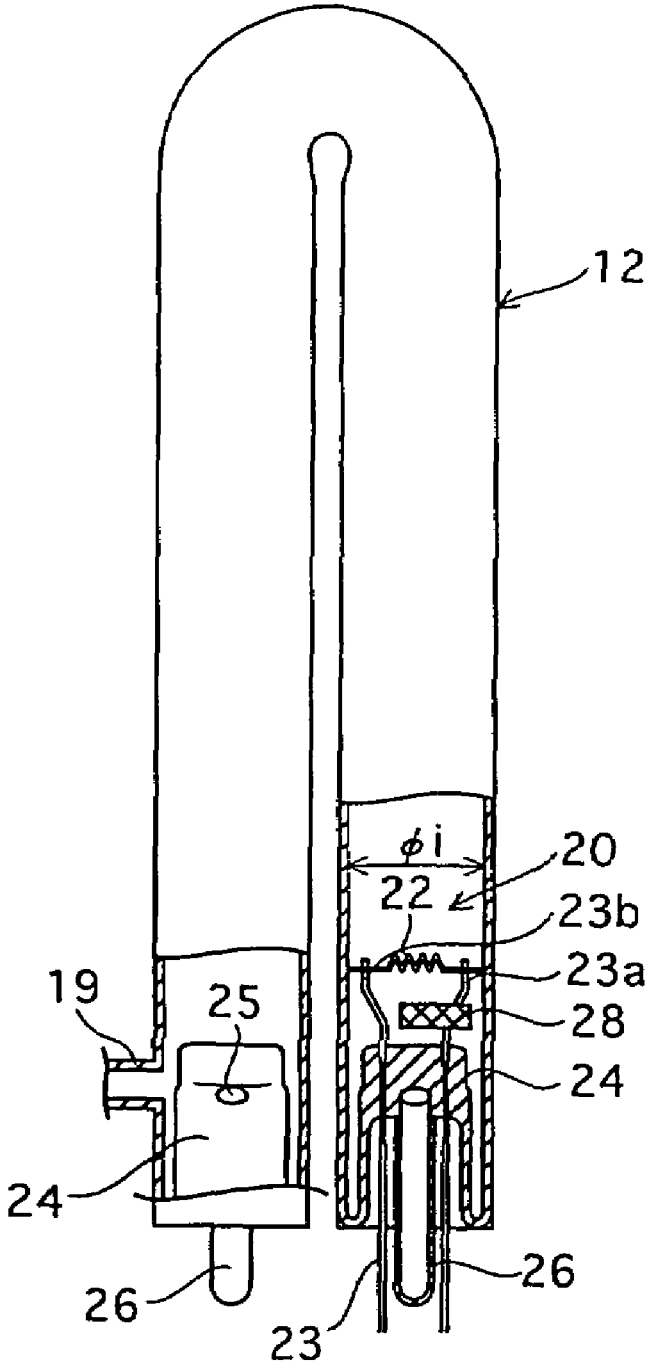
FIG. 10B is a view showing a discharge tube that is provided with an auxiliary amalgam therein, and a part of the figure is broken away to show the auxiliary amalgam.

FIG. 10A is a view showing a discharge tube having a main amalgam provided therein, and FIG. 10B is a view showing a discharge tube having an auxiliary amalgam provided therein. FIGS. 10A and 10B are broken at a part corresponding to an end of the glass tube so as to show the main amalgam and the auxiliary amalgam, respectively.

The main amalgam may be formed of, for example, mercury-bismuth-lead-tin alloy, or bismuth-indium alloy. As shown in FIG. 10A, two main amalgams 27 may be provided one in each glass tube that is adjacent to the glass tube having the electrode 20. In each of such a glass tube, the main amalgam 27 is provided within either of the fine tubes 26 near an end opposite to the stem 24 (an upper end of the fine tube as viewed in FIG. 10A). Each main amalgam 27 is supported by a positioning glass rod 29.

There is a predetermined circumferential clearance formed between the inner surface of the fine tube 26 and the outer surface of the glass rod 29. When the vapor pressure in the discharge tube rises, mercury atoms are released from the main amalgams 27 to the discharge space through the clearance. When the vapor pressure drops, on the other hand, the mercury atoms present in the discharge space are absorbed back into the main amalgams 27 through the clearance.

The auxiliary amalgam 28 is formed of indium, for example, into a mesh. As shown in FIG. 10B, two auxiliary amalgams 28 are provided one in the vicinity of each electrode filament 22. In the example shown in the figure, the auxiliary amalgam 28 is provided on one of the lead wires (the lead wire 23*a*) connected to the electrode 20.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A lighting system comprising:

a fluorescent lamp including a discharge tube formed of at least one glass tube which is bent, the discharge tube being filled with a rare gas containing at least argon; and an electronic ballast for operating the fluorescent lamp with dimming control, wherein an inside diameter of the glass tube is within a range of 12–15 mm, an overall size of the discharge tube is such that a maximum diameter is within a range of 55–70 mm and a maximum length is within a range of 120–220 mm, and the rare gas additionally contains up to 75vol % of neon.

2. The lighting system according to claim 1, wherein each glass tube is bent to form a substantially U-shape, and the discharge tube is formed of a plurality of the U-shaped glass tubes connected together, the glass tubes being arranged to form a polygonal shape in plan view.

3. The lighting system according to claim 2, wherein the discharge tube is formed of four U-shaped glass tubes.

4. A fluorescent lamp comprising a discharge tube formed of at least one glass tube which is bent, the discharge tube being filled with a rare gas containing at least argon, wherein an inside diameter of the glass tube is within a range of 12–15 mm, an overall size of the discharge tube is such that a maximum diameter is within a range of 55–70 mm and a maximum length is within a range of 120–220 mm, and the rare gas additionally contains up to 75% vol % of neon.

5. A lighting system comprising:

a fluorescent lamp including a discharge tube formed of a plurality of U-shape glass tubes, the discharge tube being filled with up to 75vol% of neon gas containing at least argon, and having a minimum inside diameter of the glass tube of 12 mm, a minimum overall outside diameter size of the discharge tube of at least 55 mm and a minimum vertical length of the glass tubes of 120 mm; and an electronic ballast for operating the fluorescent lamp with a dimming control, wherein the electronic ballast applies a normal lamp current to operate the fluorescent lamp at a full light level.

6. The lighting system according to claim 5, wherein the discharge tube is formed of four U-shaped glass tubes.

* * * * *